US005237850A

United States Patent [19]

Goldman

[11] Patent Number: 5,237,850

[45] Date of Patent: Aug. 24, 1993

[54] CONVEYOR ROLLERS AND MANNER OF THEIR MANUFACTURE

[76] Inventor: Giora Goldman, 30 Harishonim Street, Kiriat Haiim, Israel

[21] Appl. No.: 853,037

[22] Filed: Mar. 17, 1992

[30] Foreign Application Priority Data

Apr. 30, 1991 [IL] Israel ..... 098010

[51] Int. Cl.[5] ..... B21D 41/04

[52] U.S. Cl. ..... 72/398; 72/357; 72/370; 72/416; 72/325

[58] Field of Search ..... 72/398, 396, 394, 416, 72/370, 357-359, 325

[56] References Cited

U.S. PATENT DOCUMENTS

| | | | |
|---|---|---|---|
| 137,475 | 4/1873 | Parmalee | 72/398 |
| 430,539 | 6/1890 | Parmalee | 72/370 |
| 812,856 | 2/1906 | Loss | 72/325 |
| 1,104,088 | 7/1914 | Wales | 72/370 |
| 1,232,974 | 7/1917 | Rateike . | |
| 2,241,091 | 5/1941 | Hood | 72/357 |
| 2,343,403 | 3/1944 | Criley | 72/357 |
| 2,638,664 | 5/1953 | Maxson . | |
| 4,722,216 | 2/1988 | Fencl . | |
| 4,881,395 | 11/1989 | Shinjo | 72/325 |

FOREIGN PATENT DOCUMENTS

| | | | |
|---|---|---|---|
| 165232 | 11/1884 | France | 72/358 |
| 120329 | 7/1984 | Japan | 72/370 |
| 2731 | 1/1989 | Japan | 72/398 |
| 1194553 | 11/1985 | U.S.S.R. | 72/358 |

*Primary Examiner*—Daniel C. Crane
*Attorney, Agent, or Firm*—Frishauf, Holtz, Goodman & Woodward

[57] ABSTRACT

A method of reducing the end portion of a pipe to a smaller diameter of exact and smooth dimensions for fitting therein a roller contact bearing comprises the steps of; inserting into the end to be reduced a mandrel of an outside diameter coextensive with that of the bearing to be inserted and of a length coextensive with the predesignated length of the reduced portion; placing the pipe together with the inserted mandrel into a split die having a first portion of a length coextensive with that of the predesignated reduced length of the pipe and of an inner diameter coextensive with the predesignated outer diameter of the pipe, and a second portion of a diameter at least coextensive with the original diameter of the pipe; and placing the die and the pipe into a press for compressing the pipe end by means of the die and the mandrel.

8 Claims, 2 Drawing Sheets

CONVEYOR ROLLERS AND MANNER OF THEIR MANUFACTURE

BACKGROUND OF THE INVENTION

The invention relates to rollers for conveyors, both for roller conveyors and as idlers for belt conveyors. These rollers consist generally of a tube or pipe provided with one rolling contact bearing inserted into each end.

There are several methods of fabricating conveyor rollers: A roller may be produced from a pipe of a relatively strong wall thickness by internally machining its two ends to permit insertion and smooth fitting of a ball- or roller bearing. Another method, while using a thick-walled pipe consists in heating its ends and reducing the diameters in a swage block, afterwards machining their insides to the diameter of the bearings. Still another operation for reducing the end diameters is by spinning on a lathe using a mandrel. And finally fabricating conveyor rollers from thin-walled pipes includes welding short pieces of pipe of smaller diameter into the ends and machining them to the required diameter.

All these methods of fabrication are expensive and time-consuming and it is the object of the present invention to provide a method of preparing the ends of thin-walled pipes without heating and machining.

It is a main object to form the ends of pipes in a way that rolling contact bearings can be readily inserted into the ends and be secured without any auxiliary components.

It is another object to provide tools for forming the ends of conveyor rollers, which are simple and available at low cost.

And it is a further object to fabricate conveyor rollers of any required length in short operation times by using the above forming tools.

SUMMARY OF THE INVENTION

A preferred method of reducing the ends of pipes to a smaller diameter while the inside diameter is smooth and of exact dimensions for fitting therein a roller contact bearing consists in inserting into the end to be reduced a mandrel of an outside diameter coextensive with that of the bearing to be inserted, placing the pipe into a pressing die consisting of two half-dies and pressing the half-dies together by means of an eccentric or other press thereby urging the material of the pipe onto the mandrel.

The die has a stepped inner diameter, one portion consisting of a diameter coextensive with the original outer diameter of the pipe and another portion coextensive with the reduced outer diameter, the length of the reduced diameter being at least coextensive with the width of the bearing to be inserted, while the larger diameter may be of any suitable length.

The split die may consist of two halves as described in the foregoing, but may also consist of several parts to be pressed in radial direction onto the pipe outside.

In a preferred embodiment of the die and the mandrel the latter is provided with an external collar and the die with a corresponding groove into which the collar is to be inserted. Before placing the pipe into the die, the mandrel is inserted into the pipe until contact of the collar with the end of the pipe is established, the collar serving to obtain a reduced diameter portion of an exact predesignated length.

In another preferred embodiment of the die the border between the two different inner diameters is shaped in the form of an inwardly protruding collar which serves to an inwardly protruding collar in the pipe wall serving as an inner stop for the bearing so as to prevent its being inserted too far, into the large diameter portion of the pipe.

The outside cross section of the die comprising two halves is either rectangular or at least the top and the bottom of each half are planar for smooth fit into the press.

Since the pipes used are not of absolutely identical wall thickness the die is to be designed for a pipe of a minimum wall thickness, so that with a heavier pipe there will be flash protruding out between the die halves. For this reason the die halves are provided with sharp cutting edges for severing the flash from the outside of the reduced pipe section. In a die consisting of radial die sections, these can be designed for a pipe of smallest out diameter, so that with larger diameters there will remain small gaps between the sections after each pressing operation.

SHORT DESCRIPTION OF THE DRAWINGS

FIG. 1 is a longitudinal section through a pipe to be pressed into the desired shape mounted on a mandrel and positioned between the two halves of a press die, FIG. 2 is a longitudinal section similar to that shown in FIG. 1, with the die closed on the finished pipe, and FIG. 3 is a cross section of the die and the inserted pipe along line 3—3 of FIG. 2.

DETAILED DESCRIPTION OF THE DRAWINGS

Figure 1:
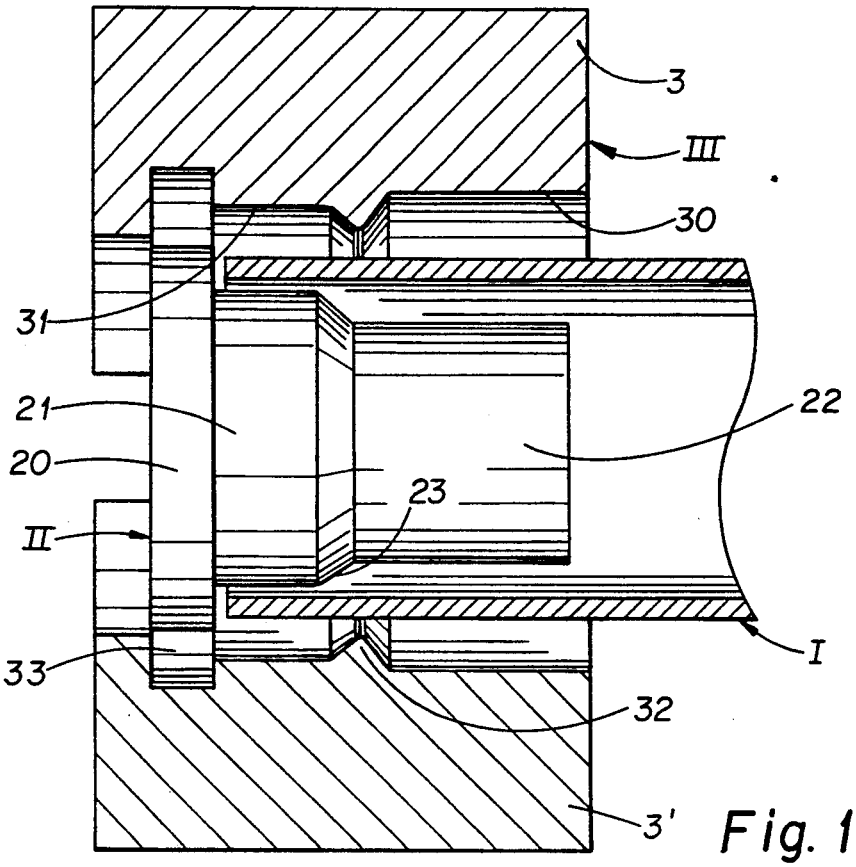

FIG. 1 shows a pipe I mounted on a mandrel II and inserted into a die III, the latter consisting of an upper half 3 and a lower half 3', which are generally interchangeable so that the lower half may become the upper and vice versa. The inside of the die is machined and hardened, usually case-hardened, in the form of a larger diameter bore 30, corresponding to the original outer diameter of the pipe, and a smaller diameter bore 31 concentric with the larger one and corresponding to the fabricated diameter of the pipe. The division between the two bores is in the shape of a smooth inwardly extending collar 32, while at the leaf-hand end of the smaller bore a circular groove 33 is provided serving to firmly located the mandrel II.

The mandrel comprises an end collar 20 corresponding to width to the groove 33 in the die halves, but being of slightly smaller outer diameter than the depth of the groove, in order to ensure safe closing of the two die halves. The mandrel is continued in a cylindrical portion 21 of a diameter identical with the outer diameter of the bearing to be inserted into the conveyor roller, and of a length coextensive with the width of the bearing to be inserted. This cylindrical portion smoothly transfers into an end portion 22 of smaller diameter by way of an inclined step 23. As can be seen in FIG. 1, the pipe I is placed onto the mandrel with its end contacting the end collar 20, while this collar is partly inserted into the groove 33 of the die.

Figure 2:
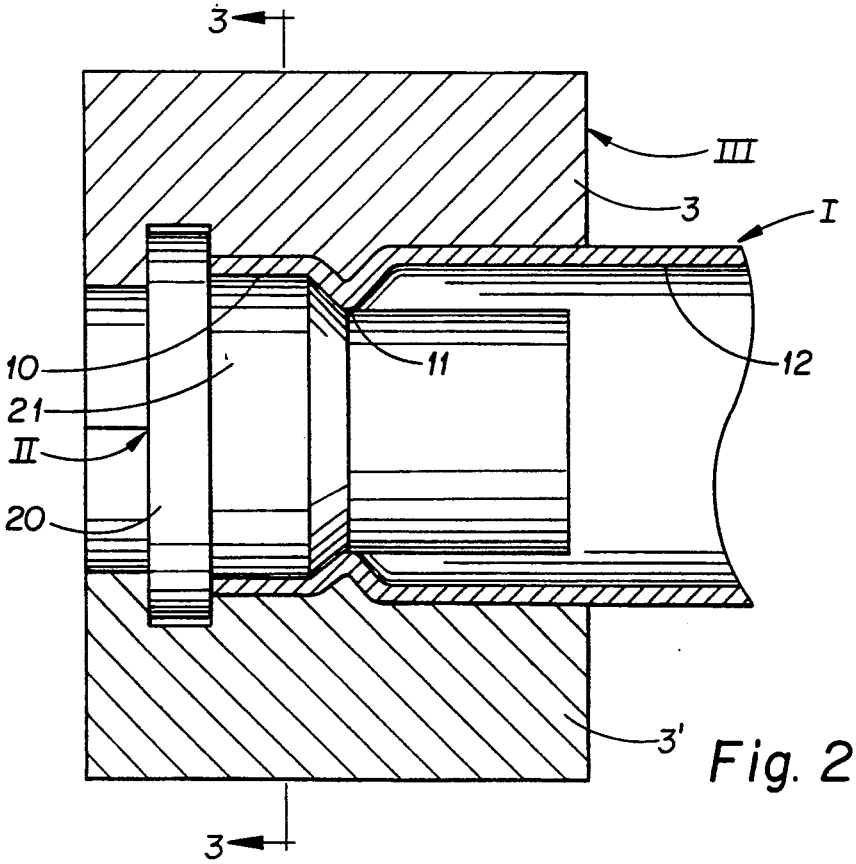
Figure 3:
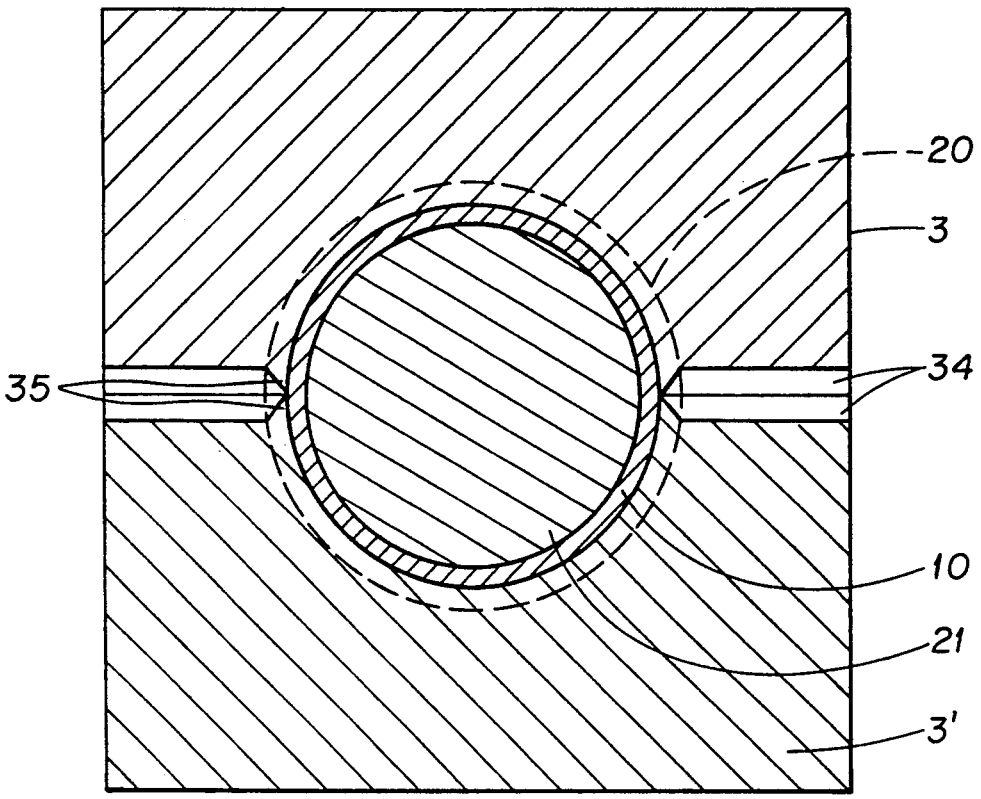

As shown in FIG. 2 and 3, the die is placed into a press (not shown) and forcefully closed so as to urge the pipe into the cavities remaining between die and mandrel, thereby reducing its end to the required diameter dimensions (10). At the same time the collar 32 of the die halves presses into the pipe and causes the formation of an inside collar 11 while the rest of the pipe 12 remains unchanged. FIG. 3 shows the closed die in cross section with the reduced pipe portion compressed between mandrel and die. This drawing also shows two recesses 34 extending along the split surfaces of the die halves and terminating in sharp cutting edges extending along the bore 31. These cutting edges serve to server the flash squeezed out of the die, and the recesses serve to receive the material severed by the cutting edges.

It will be understood that the die and the mandrel illustrated in the drawings represent only an example of the equipment suitable for reducing the pipe diameter to the required dimensions, and that alterations and modifications may be carried out to the equipment by a person skilled in the art.

The collar at the end of the mandrel is, for instance, not obligatorry and may be replaced by and other kind of stop and location of the mandrel in the die halves.

The collar 11 inside the pipe may not be necessary in all cases and may be omitted in the die and the mandrel, which will facilitate the forming operation by using smaller forces.

The die shown in FIG. 3 is of rectangular cross section, but this shape may be replaced by a cylindrical one having planar top and bottom portions for intimate contact with the anvil of the press.

The two halves of the die were called, in the foregoing, upper and lower half, but in case of a horizontal press, they should be called the front half and the rear half respectively.

The die may consist of more than two parts as described in the foregoing, as for instance of four or eight radial sections, which are pressured onto the pipe exterior in radial direction, after insertion of the mandrel.

The pipe end of be formed is generally inserted in cold state, but it may be preheated in the case of very heavy pipes or in case of a strong reduction in diameter.

I claim:

1. A method of reducing an end of a pipe from an original outer pipe diameter to a smaller predesignated reduced outer diameter having a smaller smooth inside diameter of exact dimensions for fitting therein a roller contact bearing having an outside diameter, said method comprising the steps of:

inserting a mandrel having an outside diameter equal to the outside diameter of said roller contact bearing, into the end of the pipe having the diameter which is to be reduced, placing said end of said pipe and said mandrel into a split die provided with a stepped bore having a larger diameter portion with an inside diameter equal to the original outer pipe diameter, a smaller diameter portion with the inside diameter thereof equal to the predesignated reduced outer diameter of said pipe, and an inwardly extending collar in two halves of said split die at a border between said larger and said smaller diameter portions, compressing said split die on said pipe end and said mandrel therein by pressing said pipe with said smaller diameter portion against said mandrel to form said end of said pipe in said smaller diameter portion of said bore with said predetermined reduced outer diameter while the section of pipe surrounded by said larger diameter portion remains substantially unchanged said step of compressing including the step of pressing said inwardly extending collar of said split die into said pipe to form an inwardly extending collar at an end of said smaller inside diameter of said pipe, and extracting said pipe out of said split die and said mandrel out of said pipe end.

2. The method as defined in claim 1, wherein said bearing has a length and said smaller diameter portion of said bore has a length at least equal to the length of said bearing to be inserted.

3. Equipment for fabricating a reduced diameter pipe end, comprising:

mandrel means for limiting compression of said pipe to a predesignated reduced inner diameter corresponding to an outside diameter of a roller contact bearing to be inserted into said pipe end, said mandrel means having a first portion in the form a collar of larger diameter than an original outer diameter of said pipe, a second portion of a length equal to a predesignated length of the pipe to be reduced, and a third portion of smaller diameter than said second portion, said mandrel means serving to be inserted into said pipe until said collar contacts the end of said pipe, said mandrel means being provided with a smooth transition in the shape of an inclined stop between said second and third portions, and said collar of said mandrel means is provided at an opposite end of said second portion and is circumferential, with a larger diameter than that of said second portion, and split die means for reducing an end portion of the pipe from an original outer pipe diameter to a smaller predesignated reduced outer diameter by compressing said split die means on said pipe when said pipe is positioned about said mandrel means, said split die means being composed of two halves and including a stepped bore having a first portion of a diameter corresponding to the predetermined reduced outer diameter of said pipe end and a second portion corresponding to the original outer diameter of said pipe end, said split die means being partitioned along a plane extending through a center line of said bore and having planar top and bottom surfaces parallel to said dividing plane said second portion of said split die means having a greater diameter than said first portion of said split die means when said split die means are in compressing relationship with said pipe, said first portion of said split die means being in surrounding relation to said second portion of said mandrel means and said second portion of said split die means being in surrounding relation to said third portion of said mandrel means when said mandrel means is positioned in said split die means.

4. The equipment as defined in claim 3, wherein said split die means serving to accommodate said pipe together with said mandrel means is provided with a circumferential internal groove at an end of said smaller diameter portion of a dimension suitable for receiving said collar on said mandrel means.

5. The equipment as defined in claim 3, wherein said split die means includes an inwardly protruding collar positioned between said first and said second portions for pressing a corresponding circumferential groove and collar into said pipe, serving as a stop for said bearing to be inserted.

6. The equipment as defined in claim 3, wherein said split die means is provided with a recess on each side of the partition and with a cutting edge close to said first portion of said stepped bore, serving to cut any press flash and to accommodate the press flash in said recess.

7. Equipment for fabricating a reduced diameter pipe end, comprising:

mandrel means for limiting compression of said pipe to a predesignated reduced inner diameter corresponding to an outside diameter of a roller contact bearing to be inserted into said pipe end, said mandrel means having a first portion in the form of a collar of a diameter larger than an original outer diameter of said pipe, a second portion of a diameter equal to the predesignated reduced inner diameter and of a length equal to a predesignated length of the pipe to be reduced, and a third portion of smaller diameter than said second portion, said mandrel means serving to be inserted into said pipe until said collar contacts the end of said pipe, said mandrel means being provided with a smooth transition in the shape of an inclined stop between said second and third portions, and said collar of said mandrel means is provided at an opposite end of said second portion and is circumferential with a larger diameter than that of said second portion, and split die means for reducing an end portion of the pipe from an original outer pipe diameter to a smaller predesignated reduced outer diameter by compressing said split die means on said pipe when said pipe is positioned about said mandrel means, said split die means being composed of several radial sections and including a stepped bore having a first portion of a diameter corresponding to the predesignated reduced outer diameter of said pipe end, and a second portion corresponding to the original outer diameter of said pipe, said split die means being partitioned along radial lines passing through a center line of said bore, said second portion of said split die means having a greater diameter than said first portion of said split die means when said split die means are in compressing relationship with said pipe, said first portion of said split die means being to surrounding relation to said second portion of said mandrel means and said second portion of said split die means being in surrounding relation to said third portion of said mandrel means when said mandrel means is positioned in said split die means.

8. A method of reducing an end of a pipe from an original outer pipe diameter to a smaller predesignated reduced outer diameter having a smaller smooth inside diameter of exact dimensions for fitting therein a roller contact bearing having an outside diameter, said method comprising the steps of:

inserting a mandrel having a first portion with an outside diameter equal to the outside diameter of said roller contact bearing and a second portion with an outside diameter less than the outside diameter of said first portion, into the end of the pipe having the diameter which is to be reduced, placing said end of said pipe and said mandrel into a split die provided with a stepped bore having a larger diameter portion with an inside diameter equal to the original outer pipe diameter, a smaller diameter portion with the inside diameter thereof equal to the predesignated reduced outer diameter of said pipe, and an inwardly extending collar in two halves of said split die at a border between said larger and said smaller diameter portions, said larger diameter portion being positioned in surrounding relation to said second portion of said mandrel and said smaller diameter portion being positioned in surrounding relation to said first portion of said mandrel, compressing said split die on said pipe end and said mandrel therein by pressing said pipe with said smaller diameter portion against said first diameter portion of said mandrel to form said end of said pipe in said smaller diameter portion of said bore with said predesignated reduced outer diameter while the section of pipe surrounded by said larger diameter portion remains substantially unchanged said step of compressing including the step of pressing said inwardly extending collar of said split die into said pipe to form an inwardly extending collar at an end of said smaller inside diameter of said pipe, and extracting said pipe out of said split die and said mandrel out of said pipe end.

* * * * *